US010604989B2

(12) United States Patent
Hay, III

(10) Patent No.: US 10,604,989 B2
(45) Date of Patent: Mar. 31, 2020

(54) WINDOW FRAME PROTECTION SYSTEM FOR USE IN AREAS PRONE TO STORMS

(71) Applicant: Hawkes Design and Consulting, LLC, Charleston, SC (US)

(72) Inventor: Henry M. Hay, III, Charleston, SC (US)

(73) Assignee: Hawkes Design and Consulting, LLC, Charleston, SC (US)

( * ) Notice: Subject to any disclaimer, the term of this patent is extended or adjusted under 35 U.S.C. 154(b) by 0 days.

(21) Appl. No.: 16/242,348

(22) Filed: Jan. 8, 2019

(65) Prior Publication Data

US 2019/0211611 A1 Jul. 11, 2019

Related U.S. Application Data

(60) Provisional application No. 62/614,644, filed on Jan. 8, 2018.

(51) Int. Cl.

| | |
|---|---|
| ***E06B 3/30*** | (2006.01) |
| ***E06B 1/30*** | (2006.01) |
| ***E06B 1/60*** | (2006.01) |
| ***E06B 9/02*** | (2006.01) |
| *E06B 1/36* | (2006.01) |
| *E06B 9/00* | (2006.01) |
| *E06B 3/22* | (2006.01) |

(Continued)

(52) U.S. Cl.

CPC ..... *E06B 3/308* (2013.01); *E06B 1/30* (2013.01); *E06B 1/6023* (2013.01); *E06B 9/02* (2013.01); *E06B 1/28* (2013.01); *E06B 1/363* (2013.01); *E06B 3/222* (2013.01); *E06B 3/24* (2013.01); *E06B 2009/005* (2013.01)

(58) Field of Classification Search

CPC ..... E06B 3/308; E06B 1/6023; E06B 1/30; E06B 2009/005; E06B 1/363; E06B 9/02

See application file for complete search history.

(56) References Cited

U.S. PATENT DOCUMENTS

| | | | |
|---|---|---|---|
| 7,805,897 | B2 | 10/2010 | Holland et al. |
| 7,900,408 | B2 | 3/2011 | Holland et al. |
| 7,963,313 | B1 | 6/2011 | Bennett et al. |

(Continued)

FOREIGN PATENT DOCUMENTS

| | | | |
|---|---|---|---|
| WO | 2010142787 | A1 | 12/2010 |
| WO | 2011098764 | A3 | 8/2011 |

*Primary Examiner* — Patrick J Maestri

(74) *Attorney, Agent, or Firm* — Nexsen Pruet, LLC; Michael A. Mann

(57) ABSTRACT

A window frame protection system, for holding an exterior and an interior protective panel against a window, includes an extruded lineal having a first stacked screw boss, an exterior protective panel and a groove with covering cap. Anchoring screws driven through the exterior panel and into the stacked screw boss hold the panel to the lineal. A chamber for a second stacked screw boss, and a part of the extruded lineal, is to attach an interior panel to the window frame when additional window protection is needed and when the exterior of the window frame is not accessible. The second stacked screw boss may be inserted into the chamber during construction or, if the chamber is left open, may be added only when needed. A sash support on the interior of the window frame receives a sill riser for meeting higher design loads on the window sash.

13 Claims, 4 Drawing Sheets

(51) Int. Cl.
*E06B 3/24* (2006.01)
*E06B 1/28* (2006.01)

(56) References Cited

U.S. PATENT DOCUMENTS

| | | | | |
|---|---|---|---|---|
| 8,863,452 | B1 * | 10/2014 | Hay, III | E06B 5/10 49/463 |
| 2008/0313980 | A1 | 12/2008 | Holland et al. | |
| 2017/0219162 | A1 | 8/2017 | Motosko et al. | |

* cited by examiner

WINDOW FRAME PROTECTION SYSTEM FOR USE IN AREAS PRONE TO STORMS

TECHNOLOGICAL FIELD

The present disclosure relates generally to window frames. More specifically, it relates to window frames that are designed for use in buildings in areas subject to storms and high winds.

BACKGROUND

Certain areas of the world are subject to storms with strong winds on a greater frequency than others, such as the eastern and southern coasts of the United States. Powerful storms, such as hurricanes, bring winds strong enough to lift debris into the air. Homeowners and business owners in these areas, when cautioned of an approaching storm, may install boards or other types of coverings over their windows to protect against damage from flying debris. Because the paths and intensities of storms are often uncertain, installation of these protective measures are often postponed to the last minute or, after installation, may turn out to have been an unnecessary chore when the storm follow a different trajectory, or perhaps remain unfinished when the homeowner or business owner needs to evacuate the area.

One common covering material for window frames is a sheet of plywood. There are also other covering materials such as strong fabrics and panels made of metal or of plastics such as a polycarbonate. Rigid coverings may be fastened to the house framing to protect the windowpanes from breakage. Fabrics may be fitted with grommets, and then secured to the house framing with anchoring screws driven through the grommet holes and into the framework of the residence.

A quicker and easier way to protect windows in the event of a storm would be an advantage. The amount of time, the difficulty and the inconvenience of attaching panels or other coverings over window frames in advance of a storm remain issues for homeowners and business owners.

SUMMARY

According to its major aspects and briefly recited, the present device is a window frame for use in attaching windowpanes to a home or office building at the time of construction or renovation and that is also designed to receive a protective exterior panel over the glass panes of the window frame when a storm is approaching. The present device may optionally receive an interior panel to protect the interior of the building in the event the window frame is not easily reachable from the outside for installation of a protective exterior panel.

A window frame, according to the present disclosure, includes an extruded lineal profile that may be made of a plastic, such as polyvinyl chloride. Portions of the lineal profile are used to construct the vertical framing for the window, and the remaining portions are for the head and sill of the window. The lineal profile of the present window frame system enables glazing to be carried by the window frame, and an exterior panel to be attached to the window frame, or a portion of it, such as the head and sill. The lineal profile also attachable to the underlying structural wood or masonry of the building at the opening surrounding the window frame. The window frame is thus formed using a lineal profile extruded to have the size specified for that window. Segments that comprise the window's framing, head, and sill are cut to length from the extruded profile for the particular window.

The present protective window frame system includes features that enable an interior protective panel to be installed on the inside of the window frame in order to provide supplemental protection for the interior of the home or building in the event of a storm.

A feature of the present window frame system is a chamber formed in the lineal profile with an opening dimensioned to receive an optionally-inserted second stacked screw boss. This chamber may initially be closed upon extrusion. When the present window frame is attached to the wall on a first floor opening in a building in a region not subject to winds that are particularly high, the chamber of the lineal profile may remain empty and closed. If the window frame is to be installed in a building where high winds are anticipated or the window receiving the present window frame is on the second floor, high off the ground, where it would be difficult to attach a protective panel from the outside of the building, the second screw boss may be inserted into the end of the closed chamber prior to installation so that an interior panel may be secured to the inside of the window frame using the second screw boss to hold the interior panel securely against the inside of the window frame. Although the windowpane itself may suffer storm damage, the interior panel on the inside of the window frame may protect the interior of the home or building.

Another feature of the present window frame protection system is a sill riser that can be inserted into a channel formed in the lineal profile if design loadings on the windowpane require additional resistance to pressure on the windowpane.

These and other features of the disclosure and their advantages will be apparent to those skilled in the art of window frame manufacturing from a careful reading of the present disclosure, accompanied by the following drawings.

DETAILED DESCRIPTION

The present disclosure describes a window frame protection system that requires a lineal profile for use is making a frame for a windowpane, particularly for the windowpane of a building in an area that may encounter high winds. A lineal profile, as that term is used herein, has a length and a depth and is made by forcing a moldable or malleable material through a die so that the extruded product has a cross-section that is uniform throughout its length and has the desired features for its intended purpose. The material to be extruded may be metal, plastic or a composite material, and may be conveniently made for window frames out of a thermosetting plastic such as vinyl, such as polyvinyl chloride. The length of the lineal profile is its long dimension; its width is perpendicular to its length which is, as lineal profile appears in FIGS. 1-4, the left-to-right-dimension.

The lineal extrusion is cut into specified lengths for the height and width of a window frame. A window frame is made of the assembled head, sill, and two frames for the vertical members of the window frame. The structure of the building such as a home or office building may be made of wood or masonry. The lineal profile has features that enable it to be attached to the framing structure of the building in a conventional manner.

Lineal extrusions for window frames are designed to include functional features to facilitate attachment of the window frame to the building structure and may also include aesthetic or ornamental features, such as trim elements, to provide an agreeable external appearance and to conceal joints such as the connection between the lineal extrusion and the glazing elements of the window frame. See U.S. Pat. No. 8,864,452, which describes trim for mounting exterior coverings for windows, and which patent specification is incorporated herein by reference in its entirety.

Figure 1:
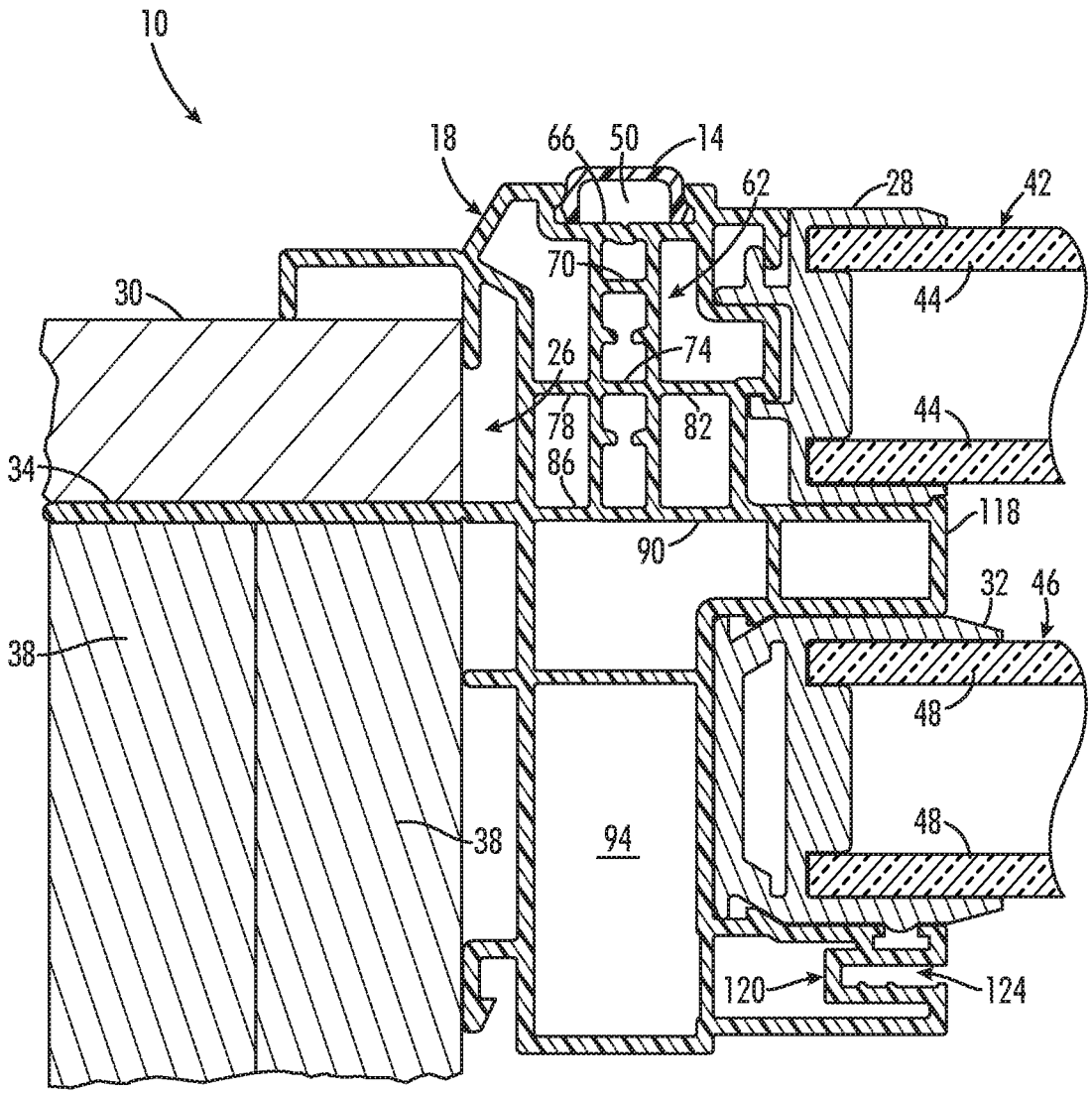
FIG. 1 is a cross-sectional view of a lineal profile of a window frame protection system including a first stacked screw boss and cap, together with a window frame, and sash, and the adjacent siding and building framing, according to an aspect of the disclosure.

Referring now to FIG. 1, there is shown a cross-section of window frame 10. A portion of window frame 10 is a lineal profile 18, formed by extrusion, with a cap 14 that is separately extruded. The cross-section shown in FIG. 1 is transverse to the major dimension of the lineal profile 18. The top of the FIG. 1 faces out of the building; the bottom faces into the building. Window frame 10 does not vary in its features and dimensions along the length of lineal profile 18. Window frame 10 shown in cross-section then reveals its internal structure and features and their relationships to the adjacent portions of the building.

Window frame 10 is oriented so that the exterior surface of window frame 10 is at the top of FIG. 1 and the interior surface is at the bottom of FIG. 1. In addition to window frame 10, lineal profile 18 and cap 14, other components, such as seals, may be added or formed integrally for aesthetic purposes such as window frame seals 28, 32, as shown in FIG. 1, that engage windowpane 42 and window sash 46, respectively.

At left in FIG. 1 is a "J-channel" 26 for receiving siding 30, for example. The lower part of J-channel 26 serves as a nail fin 34 that receives nails (not shown) driven through it and into framing studs 38, for example, to hold window frame 10 to building framing. On the right side of window frame 10 is a windowpane 42, which, as shown, may have two panes 44, for greater energy efficiency. Below windowpane 42 is a window sash 46, which may also have two panes 48.

Figure 2:
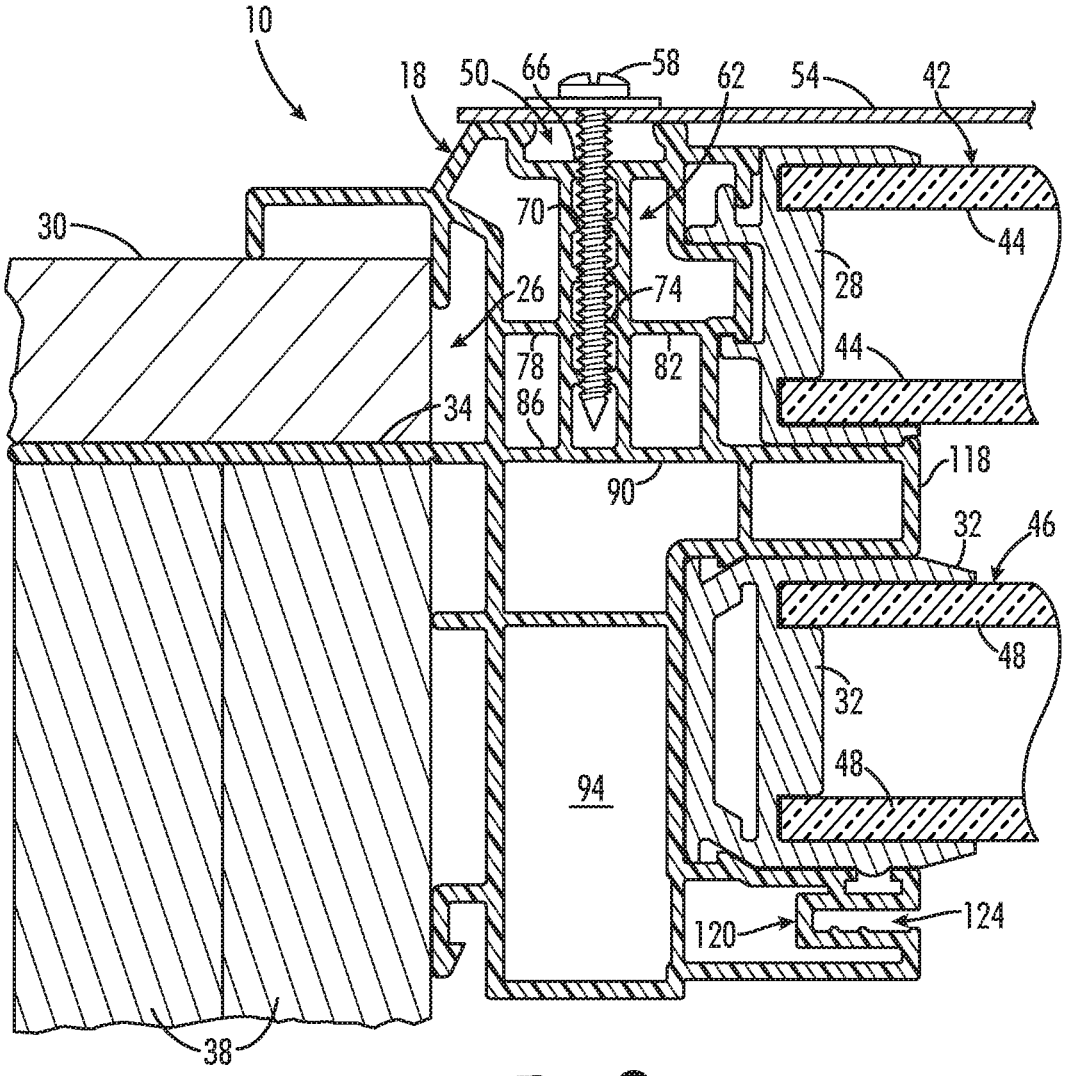
FIG. 2 shows the lineal profile of FIG. 1 with cap removed and an exterior panel held in place with anchoring screws, according to an aspect of the disclosure.

Window frame 10 has a groove 50 on its exterior surface that receives cap 14. If a storm is approaching, the resident may decide to apply a protective exterior panel 54 over window frame 10, as shown in FIG. 2. Cap 14 is pried from groove 50 of window frame 10 to expose the interior of groove 50. Exterior panel 54 may be attached to window frame 10 using anchoring screws 58 that are driven through exterior protective panel 54 and into the bottom of groove 50 and into a first stacked screw boss 62 formed in window frame 10.

Anchoring screws 58 may be driven into lineal profile 18 to attach protective exterior panel 54 at any point along groove 50. For example, screws may be driven just into groove 50 of the head and sill or of the entire circumference of the window frame. Attaching protective exterior panel 54 to just head and sill permits attachment of a decorative shutter, for example.

The term "stacked screw boss" refers to a set of spaced-apart barriers through which an anchoring screw 58 may be driven to increase the hold of the anchoring screw 58. In FIG. 2, anchoring screw 58 is used cooperatively with stacked screw boss 62 to provide a secure hold of exterior panel 54 to window frame 10 and over window 22.

In FIG. 1, stacked screw boss 62, as illustrated, has three barriers 66, 70, 74 are used. Additional structural members including braces 78, 82, 86, and 90 support and center stacked screw boss 62. The exact number and positions of barriers depends on the specifications developed for the specific materials of window frame 10, and any other materials it is holding in place in view of the applicable design conditions.

A chamber 94 is formed in window frame 10 that may be closer to the interior side of window frame 10, which is near the bottom of linear profile 10 as shown in FIGS. 1 and 2. A second stacked screw boss 98 may be added to window frame 10 by inserting it into chamber 94, as best seen by comparing FIG. 2 and in FIG. 3, if an interior panel 102 is to be attached over window sash 46 on the interior of the building.

Figure 4:
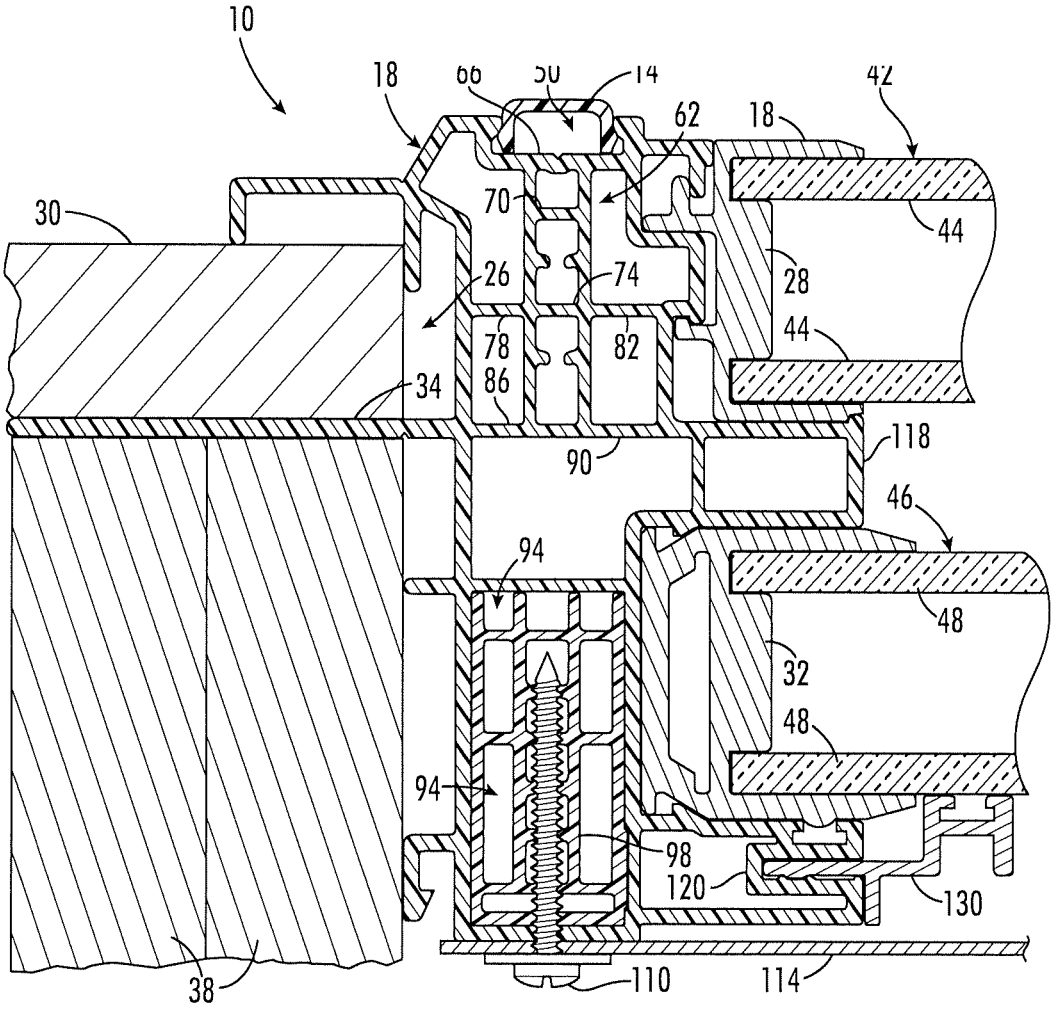
FIG. 4 is a cross-sectional view of the lineal extrusion of FIG. 2 showing a protective interior panel installed over the interior of the window frame, secured with anchoring screws to a second stacked screw boss in the window frame, and including a sill riser inserted into the channel in the inner sash support, according to aspects of the disclosure.

Interior panel 102 may be applied to the interior of window frame 10 as seen in FIG. 4 when the exterior of window frame 10 is difficult to access. Window frame 10 may be part of a second story window, for example, for its exterior to not be readily accessible. The interior of window frame 10 may, on the other hand, be readily accessible from inside a second floor room. Interior panel 102 may also be used in any window as a precaution against glass shattering into the building interior from flying objects striking window 42 or window sash 46 regardless of the use of an exterior panel 54 on the exterior of window 22.

A second stacked screw boss 98 may be inserted at a manufacturing facility based on the specifications in the purchase order provided by the builder of the home or office.

Window frame 10 may include an outer sash support 118 and an inner sash support 120, as shown in FIG. 4. Inner sash support 120 is spaced apart from outer sash support 118 by the width of window sash 46 so that window sash 46 may be held securely therebetween.

Figure 3:
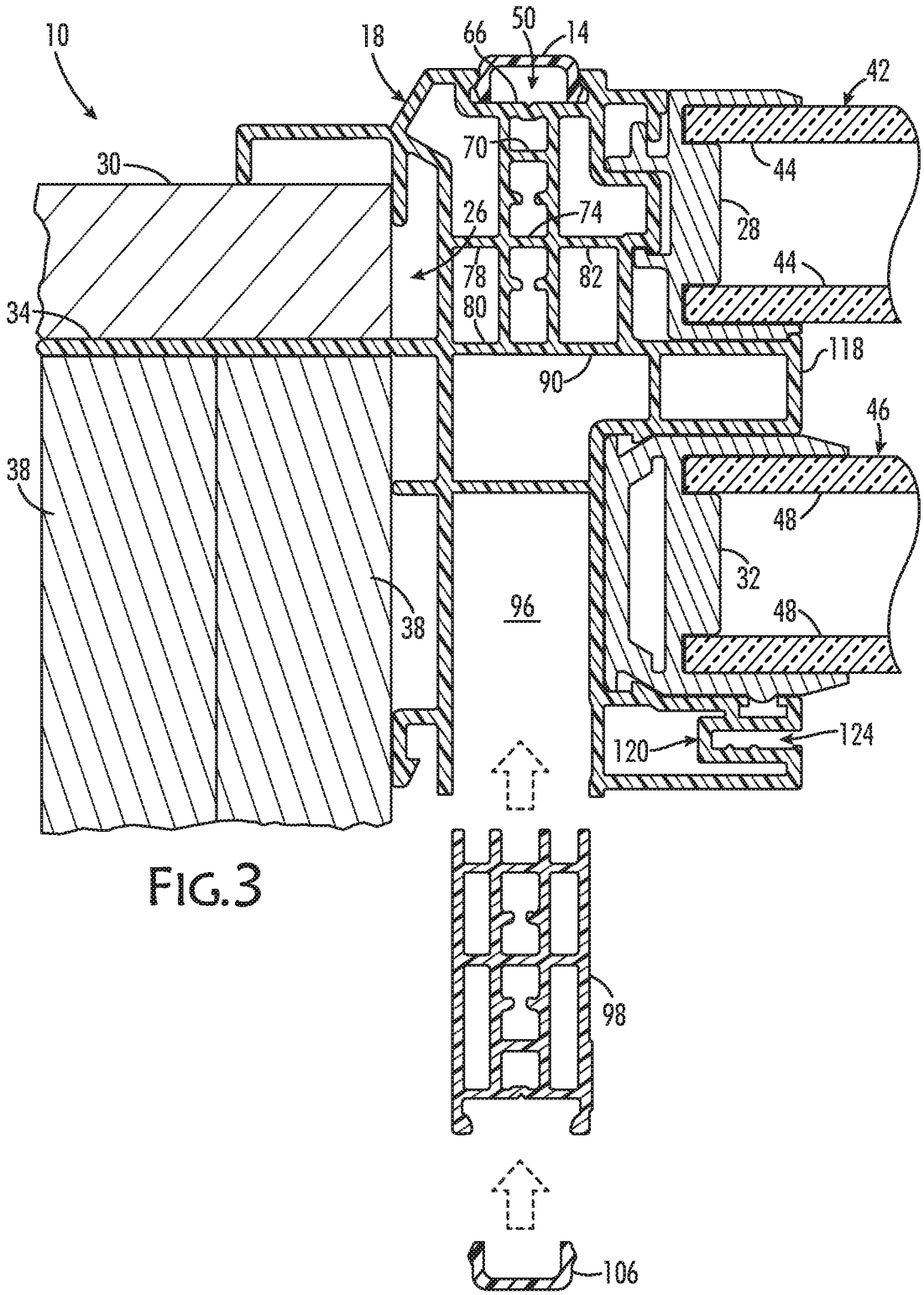
FIG. 3 is a cross-sectional view of the lineal profile of FIG. 2, with a second stacked screw boss added as shown in the chamber on the interior of the window frame, according to an aspect of the disclosure.

Inner sash support 120 is formed to have a channel 124, as best seen in FIG. 3, for receiving an optional insertable sill riser 122, shown in FIG. 4, for use when design pressure on window sash 46 requires additional support, as in the case of a strong wind event. As best seen comparing FIG. 3 and FIG. 4, sill riser 122 adds support for window sash 46 when sill riser 122 is inserted into channel 124 and presses against the inside of window sash 46 to counter forced forces against window sash 46 from outside.

Those skilled in the art of window framing and frame design will appreciate that many changes and substitutions may be made to the foregoing description of features of the disclosure without departing from the spirit and scope of the disclosed window frame 10.

What is claimed is:

1. A window frame protection system, comprising:

a lineal profile defining a groove with a first stacked screw boss, and a chamber, wherein said groove, said first stacked screw boss and said chamber are parallel to said length of said lineal profile, said first stacked screw boss having a width, and a second stacked screw boss in said chamber.

2. The window frame protection system as recited in claim 1, further comprising a lineal cap attached to said lineal profile and operable to cover said lineal profile.

3. The window frame protection system as recited in claim 1, wherein said chamber does not communicate with said first stacked screw boss but communicates with the exterior of said lineal profile.

4. A window frame protection system, comprising:

an exterior panel;

anchoring screws;

a windowpane having an exterior and an interior;

a lineal profile having an interior and an exterior, said lineal profile configured to define a groove formed therein, a first stacked screw boss and a chamber formed on said interior of said lineal profile, said first stacked screw boss being between said groove and said chamber, wherein said lineal profile is operable to hold said windowpane, and wherein said anchoring screws are operable to penetrate said exterior panel and seat in said first stacked screw boss to hold said exterior panel to said lineal profile to protect said exterior of said windowpane, and wherein said at least one windowpane includes an inner sash;

an inner sash support, received by said lineal profile and having a channel formed therein; and a sill riser inserted into said channel of said inner sash support and pressing against said interior of said one windowpane.

5. The window frame protection system as recited in claim 4, wherein said chamber is enclosed within said lineal profile.

6. The window frame protection system as recited in claim 4, wherein said chamber is enclosed by said lineal profile and wherein said window frame protection system further comprises a second stacked screw boss inside said chamber.

7. The window frame protection system as recited in claim 4, wherein said chamber communicates with the exterior of said lineal profile and wherein said window frame protection system further comprises a second stacked screw boss within said chamber.

8. The window frame protection system as recited in claim 4, wherein said chamber communicates with the exterior of said lineal profile and wherein said window frame protection system further comprises:

a second stacked screw boss inside said chamber; and an interior panel covering said windowpane and wherein said anchoring screws hold said interior panel to said interior of said windowpane.

9. A window frame protection system, comprising:

an exterior panel;

anchoring screws;

a windowpane having an exterior and an interior; and a lineal profile having an interior and an exterior, said lineal profile configured to define a groove formed therein, a first stacked screw boss and a chamber formed on said interior of said lineal profile, said first stacked screw boss being between said groove and said chamber, wherein said lineal profile is operable to hold said windowpane, and wherein said anchoring screws are operable to penetrate said exterior panel and seat in said first stacked screw boss to hold said exterior panel to said lineal profile, to protect said exterior of said windowpane wherein said chamber is enclosed by said lineal profile and wherein said window frame protection system further comprises a second stacked screw boss inside said chamber.

10. The window frame protection system of claim 9, further comprising a second stacked screw boss within said chamber.

11. A window frame protection system, comprising:

an exterior panel;

anchoring screws;

a windowpane having an exterior and an interior; and a lineal profile having an interior and an exterior, said lineal profile configured to define a groove formed therein, a first stacked screw boss and a chamber formed on said interior of said lineal profile, said first stacked screw boss being between said groove and said chamber, wherein said lineal profile is operable to hold said windowpane, and wherein said anchoring screws are operable to penetrate said exterior panel and seat in said first stacked screw boss to hold said exterior panel to said lineal profile, to protect said exterior of said windowpane, wherein said chamber communicates with said exterior of said lineal profile and wherein said window frame protection system further comprises a second stacked screw boss within said chamber.

12. The window frame protection system of claim 9, further comprising a second stacked screw boss within said chamber.

13. A window frame protection system, comprising:

an exterior panel;

anchoring screws;

a windowpane having an exterior and an interior;

a lineal profile having an interior and an exterior, said lineal profile configured to define a groove formed therein, a first stacked screw boss and a chamber formed on said interior of said lineal profile, said first stacked screw boss being between said groove and said chamber, wherein said lineal profile is operable to hold said windowpane, and wherein said anchoring screws are operable to penetrate said exterior panel and seat in said first stacked screw boss to hold said exterior panel to said lineal profile, to protect said exterior of said windowpane;

a second stacked screw boss inside said chamber; and an interior panel covering said windowpane, wherein said anchoring screws hold said interior panel to said interior of said windowpane.

* * * * *